US006234888B1

(12) United States Patent
McMinn

(10) Patent No.: US 6,234,888 B1
(45) Date of Patent: May 22, 2001

(54) METHOD AND APPARATUS FOR TRANSMISSION REPAIR

(76) Inventor: William D. McMinn, 209 E. Ave. P-3, Palmdale, CA (US) 93550

( * ) Notice: Subject to any disclaimer, the term of this patent is extended or adjusted under 35 U.S.C. 154(b) by 0 days.

(21) Appl. No.: 09/577,459

(22) Filed: May 24, 2000

Related U.S. Application Data

(62) Division of application No. 09/188,786, filed on Nov. 6, 1998, now Pat. No. 6,068,546.

(51) Int. Cl.[7] ..... B24B 41/06

(52) U.S. Cl. ..... 451/364; 125/35

(58) Field of Search ..... 451/364, 397, 451/411, 398, 402, 404, 413, 340; 125/35, 36; 269/47, 52, 16; 15/DIG. 14, 268

(56) References Cited

U.S. PATENT DOCUMENTS 6,068,546 * 5/2000 McMinn ..... 451/364

* cited by examiner

*Primary Examiner*—Derris H. Banks
(74) *Attorney, Agent, or Firm*—Locke Liddell & Sapp LLP

(57) ABSTRACT

An apparatus and method is disclosed for uniformly deglazing and finishing flat and arcuate surfaces of transmission and other automotive parts. A tapered part support engages a central opening of parts from different models and manufacturers having different size openings. Smaller parts are held in place without tightening or loosening clamps. Larger parts are simply and easily stabilized by a hold down. Operation of a power tool on the working surface of the parts continually rotates the part and part support with respect to a hand held power finishing tool. Working surfaces are thereby uniformly deglazed and roughened for replacement. High productivity is provided with an inexpensive low maintenance tool that even small shops can afford.

8 Claims, 5 Drawing Sheets

METHOD AND APPARATUS FOR TRANSMISSION REPAIR

CROSS REFERENCE TO OTHER APPLICATIONS

This is a division of application Ser. No. 09/188,786 filed Nov. 6, 1998 now U.S. Pat. No. 6,068,546 by the same inventor for which benefit is claimed under 35 U.S.C. § 120.

BACKGROUND OF THE INVENTION

1. Field of the Invention

A method and apparatus is disclosed for uniformly finishing the working surfaces of rotating automotive parts.

2. Background of the Prior Art

Automotive vehicles require a substantial number of rotating parts which have working surfaces which are in intermittent sliding contact with other parts, usually having pads made partially or solely from non-metallic heat resistant materials. Examples of these are clutch disks and clutch plates encased in a clutch drum housing of an automatic transmission. The clutch pack is a stack of alternating steel clutch plates and steel clutch disks having a fiber layer on both sides. The clutch plates usually have splines on the outside which fit splines on the inside of the housing while the clutch disks usually have splines around an opening on the inside which are engaged by a shaft running through the housing. The clutch pack is designed to lock up whereby the shaft and housing rotate together. The housing is generally cylindrically shaped with a working surface around the outside that is engaged by one or more belts. Other examples of parts that can be repaired include the working face of a fly wheel which is engaged by a conventional mechanical clutch and brake rotors which have working surfaces on both sides which are engaged by disk brake rotor pads.

Repeated engagement and disengagement of the fibrous material of the clutch disks or brake pads together with the combined effects of heat and chemical reactions, such as oxidation or hydration, results in glazing of the working surfaces over time. The glazed surfaces are nonuniformly glazed. Glazing of these surfaces can result in undesirable slippage or inconsistency. In the case of automatic transmission clutch packs, smoothness of operation can be undesirable affected. Therefore, there is a need in the automotive repair art to deglaze working surfaces of rotating parts. The deglazed surfaces need to be uniformly deglazed and refinished.

Equipment is available to deglaze working surfaces of rotating automotive parts, but it is expensive and difficult to operate and maintain. Many of the automotive repairs that are done in the United States are done in small shops dispersed throughout the country. There has been a need for an economic alternative to hand sanding which is time consuming and difficult to perform in such a way to produce a uniform surface on both sides of a circular plate. Because the job is especially onerous when rebuilding automatic transmissions which have multiple plates, workmen are prone to simply replace the old parts without adequate sanding or alternatively, throw them all away and replace them unnecessarily with costly new parts.

SUMMARY OF THE INVENTION

The invention is an apparatus and method for deglazing working surfaces of rotating automotive workpiece parts having centered openings of different sizes. A stand is provided having a generally upright first supporting connection. A second supporting connection is associated with a part support body, having an upper rim, a lower rim and an intermediate support structure connecting the upper rim and lower rim. The intermediate portion tapers outwardly from the upper portion as it extends downwardly toward the lower portion where the intermediate support structure progressively increases in size.

The first and second supporting connections are rotationally engageable to mount the part support body on the stand at a convenient elevation for working and allow turning of the part support body with respect to the stand. Transmission parts with flat working surfaces or cylindrical parts with cylindrical working surfaces each have a central opening. The size of these openings on parts from different manufacturers vary as do the diameters of the central openings in brake rotors and fly wheels. The apparatus and method is applicable generally to circular parts with a center opening.

The central opening of the part is passed over the upper rim and moves down along the intermediate support structure until the diameter or size of the intermediate support structure is the same as the opening. The upper working surface of the part is exposed in an upward direction for the operator. When the working implement of a rotary power tool is pressed against the working surface, the part and part support body are automatically continually rotated in response to operation of the rotary power tool. The working surface is uniformly cleaned and roughened. The first and second supporting connections are connected in a manner that provides for frictionally retarded rotation of the part support body in response to rotational forces generated on the workpiece by the power tool so the part rotates but does not spin out of control. Spinning out of control reduces the efficiency of the grinding implement and presents a potential operator hazard.

The first and second supporting connections preferably comprise a rotatable joint having a stem and socket which are quickly and easily separated and connected without the use of tools. A socket is preferably provided as the first supporting connection in the stand with a stem fixedly connected in the center of the part support body. The part support bodies are preferably shaped in the form of cones of different sizes so that almost any diameter of opening in a workpiece part can be accommodated by changing to an appropriate sized cone mounted on the stand.

The part support body preferably includes a part support body having an extension which extends upward a distance above the upper rim and a hold down mountable on the extension after a workpiece having first and second openings has been passed down over the extension where it rests on the part support body. The hold down is preferably spring loaded by means of a spring supported on the extension compressing the hold down part against the workpiece. The hold down preferably has a tapered surface which may be as an inverted cone which fits into a second central opening in the workpiece to accommodate workpieces having different sized second central openings spaced above the first central opening when the part is installed on the part support. The first and second supporting connections are frictionally retarded by a friction surface between them in such a manner that the working surface, in response to working contact with the power tool, turns continually but relatively slowly as compared with the rotating speed of the power tool. The tool is quite inexpensive and requires essentially no maintenance because the parts are the essence of simplicity.

DETAILED DESCRIPTION OF THE INVENTION

Figure 1:
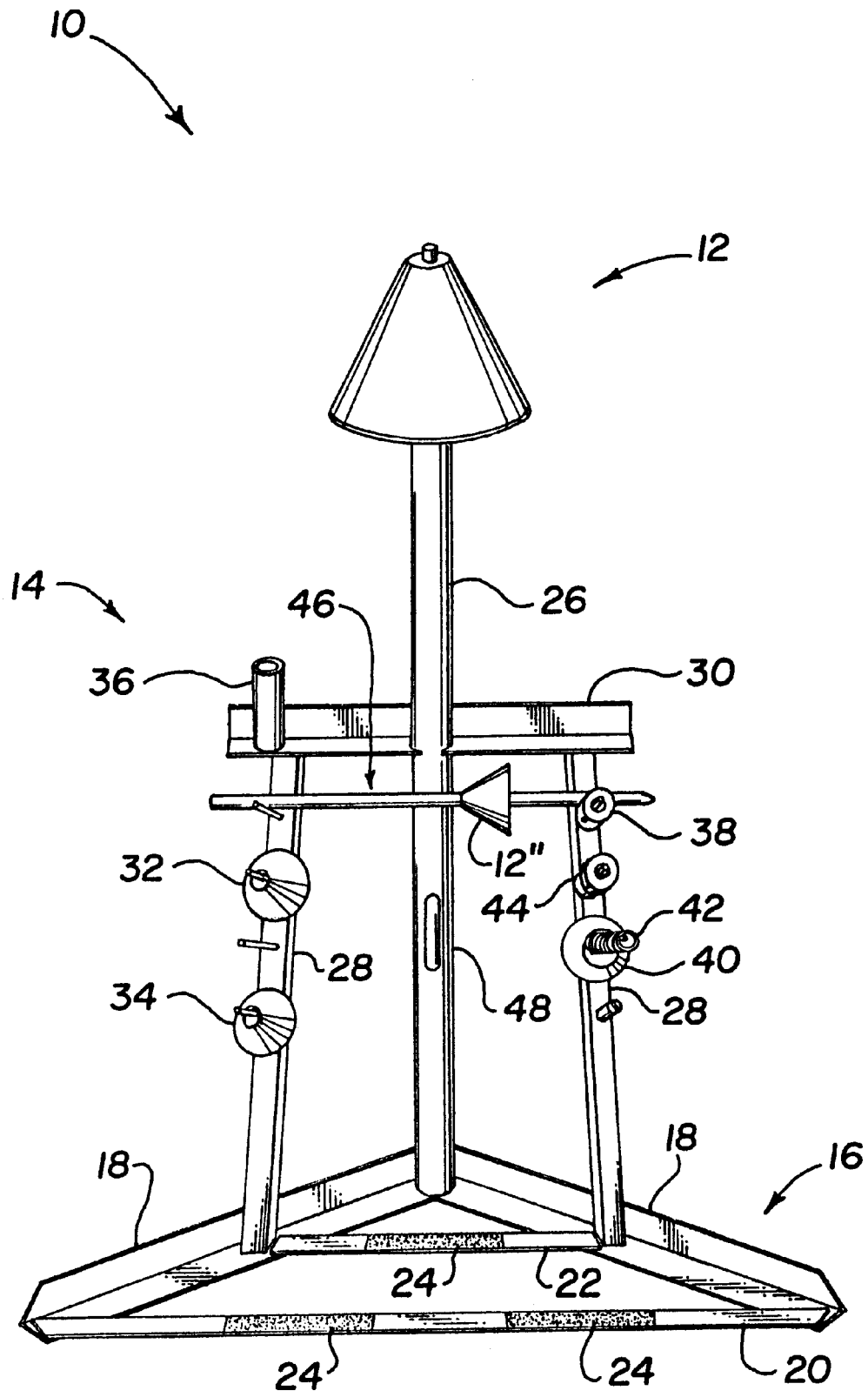
FIG. 1 is a perspective view of the stand including one form of hangers which conveniently store various cone shaped part support bodies.

A transmission repair apparatus generally designated by the reference numeral 10 is shown in FIG. 1. It is especially well suited to the deglazing and refinishing of working surfaces of the multiple clutch plates present in modern automatic transmissions. It is more generally a repair apparatus for automotive or other parts which have a centrally located opening which is used to support the part on a part support body 12. Examples of other such parts include fly wheels for clutch operated cars and brake rotors.

Part support body 12 is supported for rotation on a stand generally designated as stand 14. Stand 14 has a base portion 16 formed from interconnected legs 18 and 20 which are arranged in a triangular orientation with a stiffening leg 22. Roughened areas 24 are provided for an operator to stand on without slipping. The bottom of base portion 16 may have a solid plate or be of some other shape sufficient to support an upright post 26. A pair of shorter upright posts 28 are supported on the base and connected rigidly at their upper ends with post 26 through cross member 30. Shorter upright posts 28 are provided with slightly upwardly angled pins to store components of apparatus 10. Left side post 28 has smaller sized part supports 32 and 34 hanging on the pins. Cross member 30 has a welded support 36 for storing part support body 12. The right hand post 28 has a collar 38, a hold down 40, a spring 42 and a first supporting connection 44 stored on pins. A modified support body 46 is supported by legs 28. A seal remover 48 may be included for removing rear transmission seals. These parts will be further discussed in connection with the other figures.

Figure 2:
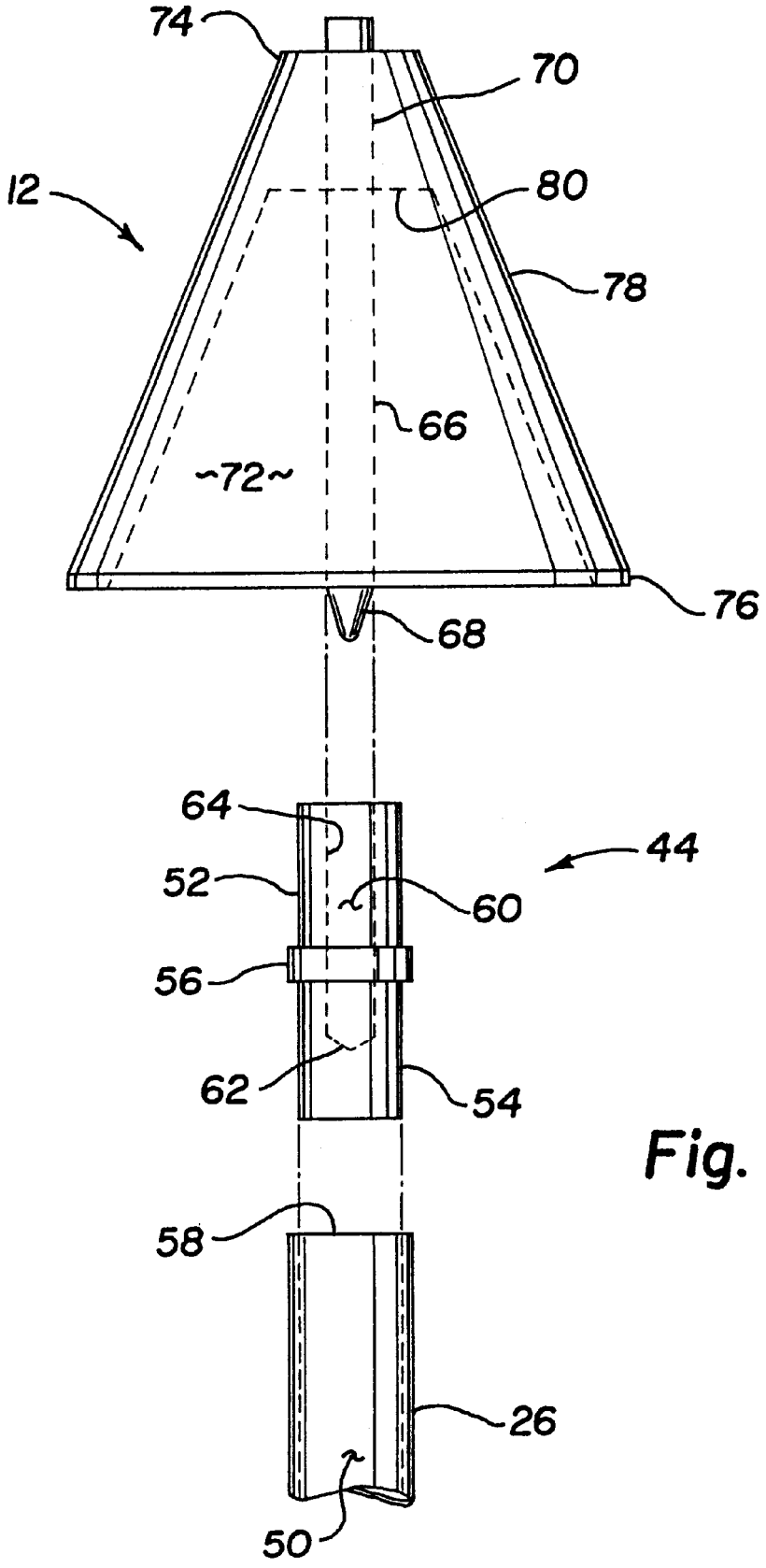
FIG. 2 is a partially cut away side elevation view of the top post of the stand, first and second connection means and a part support body having a cone shape.

In FIG. 2, the upper end of upright post 26 is a pipe having an opening which seats a first supporting connection 44 having an upper portion 52, a lower portion 54 and an abutment 56 between them. Lower portion 54 fits opening 50 and abutment 56 rests upon top 58 of post 26. The interior of connector 44 comprises a socket 60 having a cone shaped bottom 62. Socket 60 preferably has a cylindrical wall 64 which forms an opening for receiving a stem 66 centrally located within body 12 and having a cone shaped lower end 68 which may be supported in bottom 62 when the parts are put together. Stem 66 comprises a second supporting connection which is fixed at upper portion 70 within cone shaped part support body 12. Stem 66 extends unsupported through a void area 72 within body 12 as indicated by the dotted lines. Body 12 has a small upper rim 74 at its upper portion, a larger lower rim 76 at its lower portion and an intermediate support structure, preferably a support surface 78 connecting the upper and lower rims 74, 76. Intermediate support structure 78 comprises a tapered side portion tapering outwardly and progressively increasing in size from the upper portion to the lower portion of body 12. In assembly, the top of supporting connection 44 may be designed to rest in contact with an internal surface 80 at the upper part of void 72. The frictional retardation preferably comes from the friction between stem 66 and wall 64 together with friction between bottom 62 and end 68.

Figure 2A:
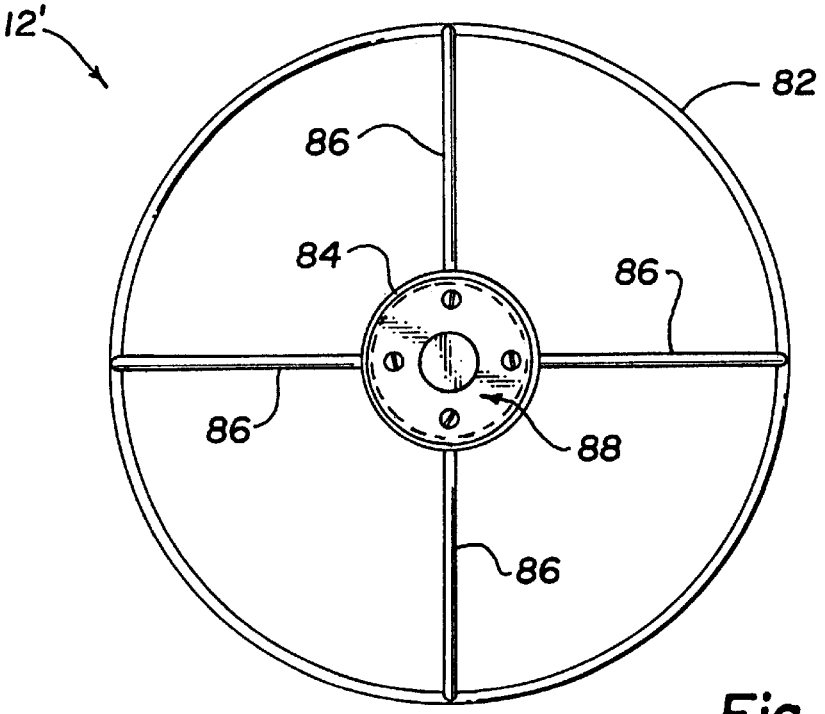
FIG. 2A is an alternate form of part support body made mainly of heavy wire and viewed from above.
Figure 2B:
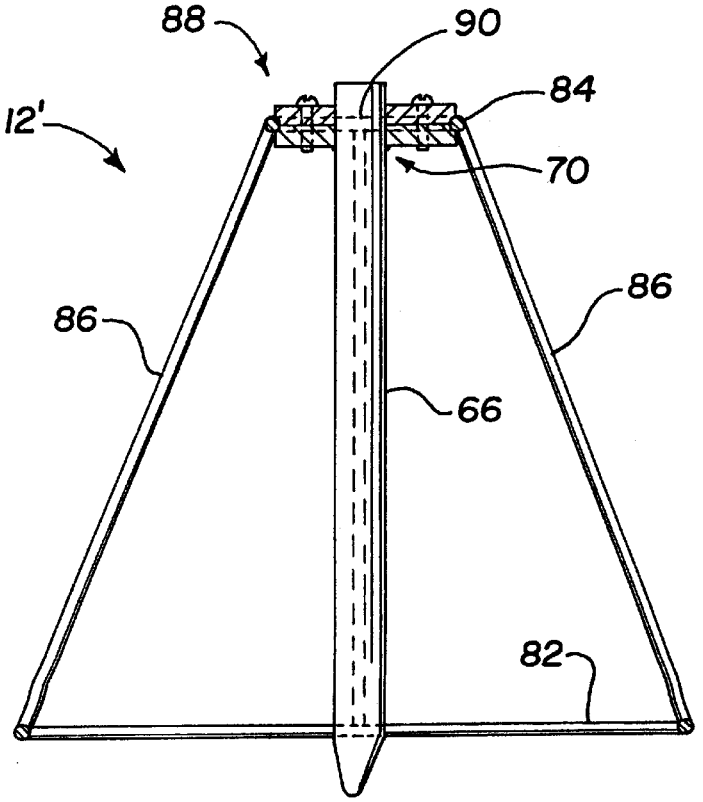
FIG. 2B is a side elevation view of the alternate part support shown in FIG. 2A.

An alternate form of a part support body is shown in FIGS. 2A and 2B. Part support body 12' has a lower portion comprising a lower rim 82, an upper portion comprising an upper rim 84 and an intermediate support structure 86 comprising four heavy wire legs which taper outwardly from the upper portion 84. Since the area between the legs 86 is open, the structure can support a part having a square central opening. It is evident that a similar part with six or eight legs 86 would be well suited for parts having a hexagonal or octagonal opening. The corners of an opening would rest at some level in contact with the legs 86. A cap structure 88, comprising a pair of circular disks, captures the upper rim 84 at a groove 90 to rigidly support stem 66 centered therein. The upper portion 70 of the stem may be welded or otherwise fastened to structure 88.

Figure 4:
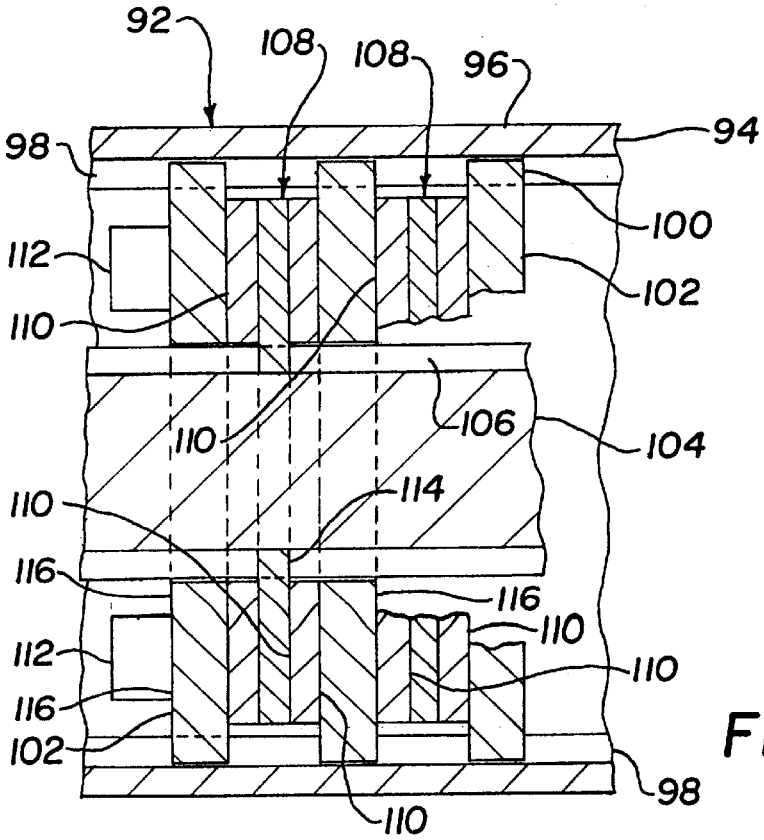
FIG. 4 is a schematic illustration of a clutch pack in a clutch housing cut away along the center line.

FIG. 4 schematically represents a clutch pack in a clutch drum for an automatic transmission. Clutch drum 92 has a circular outer wall 94 having external working surface 96 on which clutch bands ride. The inner surface of wall 94 is provided with splines 98 which engage splines 100 on clutch plates 102. A shaft 104 with splines 106 around it periphery passes into the center of drum 92. Clutch plates have an opening in the shaft but do not engage the splines on the shaft. Alternately spaced between clutch plates 102 are clutch disks 108 having a facing 110 made of fibrous material. Hydraulic cylinders 112 press against the clutch pack to frictionally engage the flat working surfaces of clutch plates 102 against the flat fibrous surfaces 110 of clutch disks 108. Since clutch disks 108 are provided with splines 114 which engage shaft 104, pressing together of the plates and disks causes the transmission to lock whereby shaft 104 and drum 92 turn together. The steel clutch plates have flat working surfaces 116 on opposite sides which engage the facing 110. If the working surfaces 116 become burnished and glazed from use, it takes too long to "lock up" and that creates wear and heat which damages parts. The transmission fluid can actually get black from clutch material. I believe it is important to have working surfaces which are flat but not too smooth in order to get a smooth, controlled and sure lock up of these relatively moving parts. It is desirable that these surfaces have a scratch pattern and important that the scratch pattern be uniform around the entire surface in order to get smooth and uniform lock up. It is very difficult to produce such a surface by hand.

Figure 3:
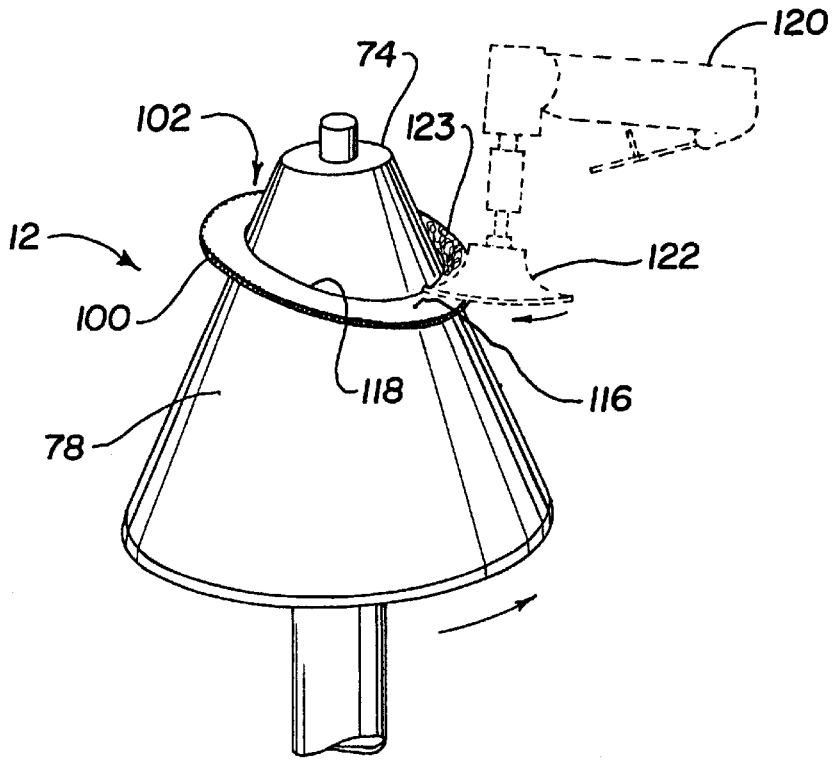
FIG. 3 is a perspective view showing a working surface of a transmission clutch plate for an automatic transmission being deglazed and finished with the rotary power tool illustrated in dotted outline.

FIG. 3 shows how the problem of producing such surfaces is surely and economically done. FIG. 3 illustrates the assembled part support 12 of FIG. 2 wherein a clutch plate 102 having a central opening larger than rim 74 has simply been dropped onto support 12 to come to rest on intermediate support surface 78. A rotary air tool 120 having a working implement 122 is pressed against the working surface. An 80 grit or finer sandpaper or Scotch Brite™ is attached to its rotating bottom to produce a uniform scratch pattern 123 while imparting a rotation indicated by the arrows. The part 102 and part support body are automatically rotated by operation of the rotary power tool in contact with working surface 116 which is frictionally retarded preferably by frictional contact between the outer surface of stem 66 and wall 64 of socket 60. The degree of frictional retardation which is desired as indicated by the following example. When tool 120 is an Ingersoll Rand Model 301 Right Angle Die Grinder operating at 90 psig, the air sander implement 122 turns at 22,000 rpm. Simultaneously the desired rotational speed of the combined part and part support is about 200–300 rpm. The rotation provided by the grinding action is continual and insures that all portions of the surface are uniformly deglazed and finished. When the first surface is finished, it is a simple matter to flip the disk 102 over and similarly deglaze and finish the opposite surface 116. The beauty of the system is its simplicity and ability to handle clutch disks and other parts from different makes and models of automotive equipment which have different sizes and especially different central opening diameters. The tapered support surface 78 allows the part to find its own level automatically. The part automatically maintains itself in the working orientation shown caused by the pressing of the power tool against the surface 116. For smaller circular parts, it is a simple matter to remove the part support 12 and substitute a smaller part support 32 or 34.

Figure 6:
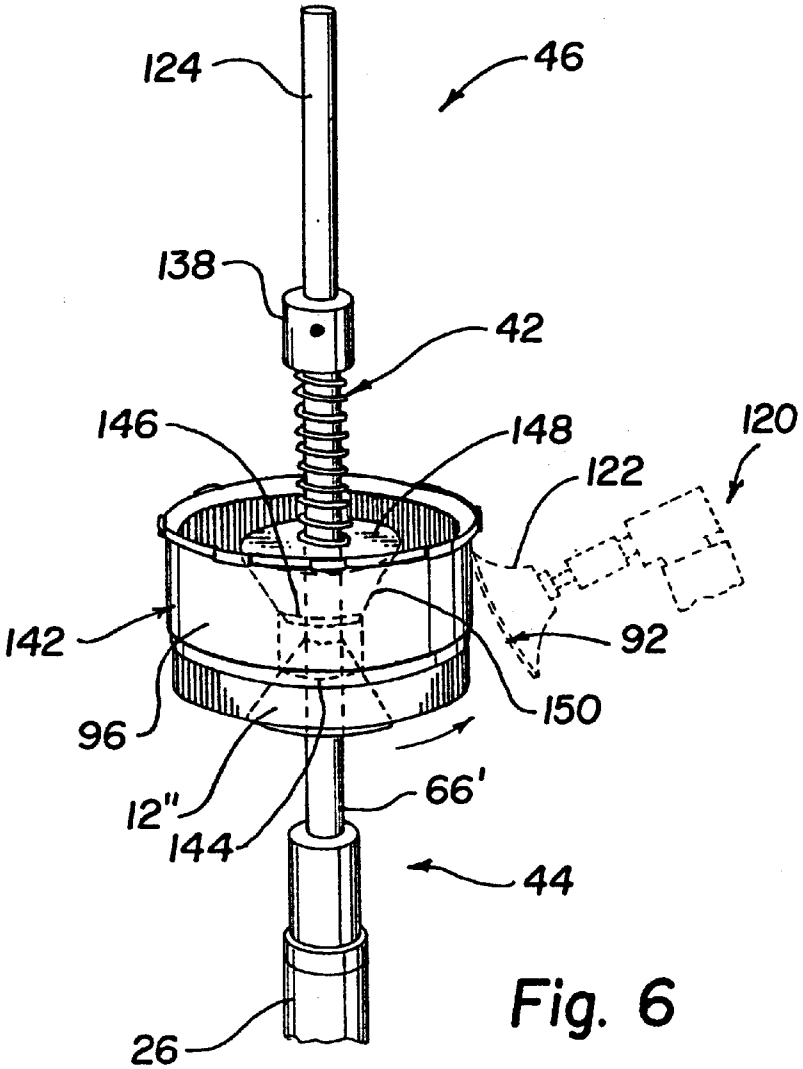
FIG. 6 is a perspective view of the clutch drum or housing of an automatic transmission with the first central opening being supported by a part support body mounted on the stand and an inverted cone shaped additional part support body serving as a hold down positioned in the second central opening and held in place on the extension by the spring and clamping collar with the power tool in dotted outline operating on the outer cylindrical surface.
Figure 5:
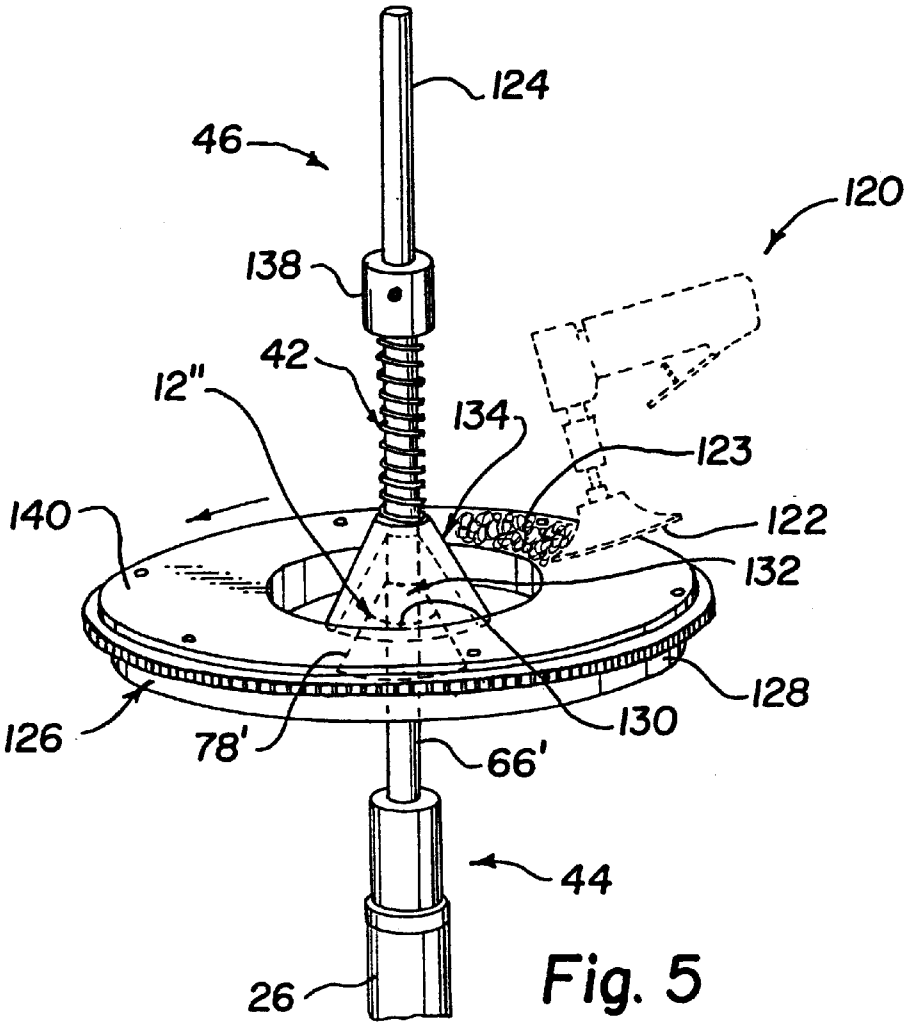
FIG. 5 is a perspective view of a rotating fly wheel positioned on a part support surface having and extension, showing the extension with an additional hold down, spring and collar showing the rotating power tool in dotted outline.

The versatility of the apparatus and method is illustrated by reference to FIGS. 5 and 6. FIG. 5 illustrates the deglazing and refinishing of a fly wheel whereas FIG. 6 illustrates the deglazing and refinishing of band surface 96 for clutch drum 92. In both cases only the upper portion of stand 14 is shown with the first supporting connection 44 having its lower portion 54 mounted inside the open upper end of post 26. Neither the post 26 nor connection 44 are designed to rotate in the preferred embodiment. It is conceivable that a variation of the support 44 might allow the rotation to occur at post 26 provided a sufficient degree of retardation is provided so that the fly wheel or other part being worked on does not free wheel and build up dangerous high speeds.

In FIG. 5, modified support body 46 has a stem 66' and an extension 124 which extends upward above the upper rim of part support body 12". Extension 124 may be a continuation of stem 66'. A fly wheel 126 has a cylindrical lower portion 128 with an opening through its center which may be regarded as a first central opening 130, indicated by the dotted line, and a second central opening 132 spaced above first central opening 130, which is hidden in FIG. 5. Fly wheel 126 is lowered down over the extension 124 such that the first central opening comes to rest at the appropriate place along intermediate support surface 78' of part support body 12". A cone shaped hold down 134 has a tapered outer surface having an opening for extension 124 to pass through is dropped onto the area surrounding second central opening 132 with the wider portion in contact with that portion of the fly wheel. Spring 42 is slipped over extension 124 and compressed slightly by a collar 138 which may be fixed in place on extension 124 by means of a set screw or similar device. Fly wheel 126 has a working surface comprising a clutch face 140 which is worked on by working implement 122 of rotary air tool 120. This is used to produce a deglazed finished surface 123 in a continuous manner by rotating fly wheel 126 in response to operation of power tool 120 to uniformly clean and roughen the clutch face of the fly wheel. If the working implement is pressed down with sufficient force, hold down 134 can actually be raised slightly compressing spring 42 to put the fly wheel in a tilted orientation (like FIG. 3) with respect to horizontal and it will continue to rotate in that same tilted orientation. This provides a certain degree of give which promotes greater uniformity in the finishing operation being conducted.

FIG. 6 illustrates the same set up as FIG. 5 for deglazing and finishing a circular working surface 142 of clutch drum 92. The clutch drum has a first central opening 144 and a second central opening 146 spaced some distance above central opening 144. A truncated cone shaped hold down 148 having an opening through its center and an intermediate support surface 150 is inverted and placed down onto extension 124 with the intermediate support surface 150 in supporting contact with central opening 146. The intermediate support surfaces of cone shaped part support 12" and inverted cone shaped hold down 148 automatically find the edge of the first and second central openings to hold the part in place. In response to operation of power tool 120, working surface 142 continually rotates along with the hold down and supporting parts on stem 66'. There is enough frictional retardation or resistance in between stem 66' and connection 44 to prevent totally free wheeling of the part being worked on in response to operation of the power tool. Working surface 142 is continually and uniformly deglazed and refinished.

In the best mode, the stand, stem, extension and spring are made from steel and the first supporting connection, part support bodies and hold down are preferably made from aluminum. While the first supporting connection is shown to be a socket with a stem on the part that rotates, it is evident that this orientation could be reversed such that the stem extends from the stand 26 and the socket could extend downward from the part support body with an opening to be received by the upwardly extending stem. In other words, the socket and stem could be reversed. Other forms of a rotatable connection with some frictional retardation could be provided without departing from the spirit of the invention.

What is claimed is:

1. A method of uniformly deglazing working surfaces of automotive parts comprising workpieces having centered openings of different sizes, the method comprising:

providing a stand;

providing a part support body having an upper portion, a lower portion and a tapered side portion tapering outwardly from the upper portion and extending downwardly to the lower portion;

rotationally mounting the part support body on the stand with the upper portion above the lower portion in a manner that provides for frictionally retarded rotation of said body in response to rotational forces generated on said workpiece by a power hand tool;

collecting one or more workpieces with a working surface having a first opening which fits on the part support body between the upper portion and the lower portion;

depositing one of said workpieces on the part support body with the first opening in the workpiece supported by means of the tapered side portion of the part support body; and pressing a working implement of a rotary power tool against the working surface while operating the tool and rotating the workpiece thereby uniformly cleaning and roughening the working surface.

2. The method of claim 1 wherein the step of rotationally mounting the part support body on the stand includes the step of providing a rotatable joint having a stem and socket and engaging the stem and socket.

3. The method of claim 1 wherein the step of collecting one or more workpieces and depositing one of said workpieces on the part support body comprises collecting and depositing steel clutch plates from an automatic transmission having flat clutch plate surfaces and the step of pressing a working implement against the working surface comprises the step of operating the working implement on the flat clutch plate surfaces.

4. The method of claim 1 wherein the step of providing a part support body comprises the step of providing a part support body having an extension which extends upward a distance above the upper portion, the step of collecting one or more workpieces comprises the step of collecting one or more workpieces having a first opening in the center and a second opening spaced from said first opening wherein the step of depositing said workpiece on the parts support body comprises the step of passing the extension through both openings whereby the first central opening is supported by the tapered side portion of the part support body and further includes the step of additionally supporting said workpiece on said part support body.

5. The method of claim 4 further including the step of providing a hold down mountable on the extension after said workpiece is supported on the part support body wherein said hold down is adapted for supporting said workpiece in place on the part support body for rotation with the part support body.

6. The method of claim 5 wherein the step of collecting one or more workpieces is the step of collecting a fly wheel for an automotive vehicle having a clutch face, said fly wheel having first and second openings defined by an opening for a shaft, the step of depositing said workpieces on the part support body comprising the step of depositing a first surface on the tapered side portion of the part support body while supporting the second opening by means of the hold down and the step of pressing the working implement comprises the step pressing the working implement against the fly wheel face including the step of rotating the fly wheel in response to operation of the power tool to uniformly clean and roughen the clutch face of the fly wheel.

7. The method of claim 6 further including the step of providing a spring adapted to fit the extension including the step of loading the hold down by means of the spring and further including the step of allowing the fly wheel to tilt while compressing the spring in response to force imposed on the fly wheel face during rotation by the working implement.

8. The method of claim 5 wherein the step of collecting one or more workpieces is the step of collecting a clutch housing for an automotive transmission having said first and second openings defined by an opening for a shaft and a arcuate external working surface surrounding said opening, the step of depositing said workpieces on the part support body comprises the step of depositing the first surface on the tapered side portion of the part support body while supporting the second opening by means of the hold down and the step of pressing the working implement comprises the step of pressing the working implement against the arcuate working surface including the step of rotating the clutch housing in response to operation of the power tool to clean and roughen the working surface of the clutch housing.

* * * * *